US006125559A

United States Patent [19]

Mullenhour

[11] Patent Number: 6,125,559

[45] Date of Patent: Oct. 3, 2000

[54] PLOW TRIP BOARD BIASED BY ELASTIC TORSION JOINT

[75] Inventor: William Newton Mullenhour, Delphos, Ohio

[73] Assignee: The Gledhill Road Machinery Co., Galion, Ohio

[21] Appl. No.: 08/987,503

[22] Filed: Dec. 9, 1997

Related U.S. Application Data

[60] Provisional application No. 60/033,123, Dec. 10, 1996.

[51] Int. Cl.[7] ..... E01H 5/04

[52] U.S. Cl. ..... 37/232; 37/266; 172/816; 403/225

[58] Field of Search ..... 37/232, 233, 266, 37/219; 172/810, 811, 816, 685, 681, 692, 693; 403/225, 226, 227, 228

[56] References Cited

U.S. PATENT DOCUMENTS

| | | | |
|---|---|---|---|
| 2,055,291 | 9/1936 | Henry | 37/233 |
| 2,712,742 | 7/1955 | Neidhart | 64/14 |
| 3,601,424 | 8/1971 | Badland | 280/124 |
| 3,687,479 | 8/1972 | Kober | 280/124 R |
| 3,772,803 | 11/1973 | Cote | 37/233 |
| 3,783,639 | 1/1974 | Goodman et al. | 64/27 NM |
| 3,837,610 | 9/1974 | Ewers | 403/225 X |
| 3,905,596 | 9/1975 | Barber | 272/29 |
| 4,255,878 | 3/1981 | Mahler et al. | 37/232 |
| 4,307,523 | 12/1981 | Reissinger et al. | 37/232 X |
| 5,140,763 | 8/1992 | Nchols, IV | 37/233 |
| 5,191,729 | 3/1993 | Verseef | 37/232 |
| 5,591,083 | 1/1997 | Kirschey | 464/83 |
| 5,697,172 | 12/1997 | Verseef | 37/232 |
| 5,743,032 | 4/1998 | Vauhkonen | 37/233 X |

FOREIGN PATENT DOCUMENTS

| | | | |
|---|---|---|---|
| 1243526 | 9/1960 | France | 37/232 |
| 1255480 | 1/1961 | France | 37/232 |
| 2004447 | 8/1971 | Germany | 37/232 |
| 3205973 | 9/1983 | Germany | 37/232 |
| 3205974 | 9/1983 | Germany | 37/232 |
| 25 04 859 | 8/1975 | Netherlands . | |
| 751891 | 7/1980 | U.S.S.R. | 37/232 |
| 1058602 | 2/1967 | United Kingdom | 37/232 |

*Primary Examiner*—Victor Batson

*Attorney, Agent, or Firm*—Craig A. Fieschko, Esq.; DeWitt Ross & Stevens S.C.

[57] ABSTRACT

A plow blade is described which has first and second sections, e.g., a moldboard and a trip board, which are rotatable with respect to each other and maintained in a desired angular relationship with respect to each other via an elastic torsion joint. The elastic torsion joint includes an elongated inner member at least partially surrounded by an elongated outer sleeve. Resilient elastic cushioning wedges (e.g., elastomeric wedges) are situated between the inner member and outer sleeve in such a manner that rotation of the inner member with respect to the outer sleeve compresses the cushioning wedges and elastically resists rotation. The inner member and outer sleeve are respectively affixed to the moldboard and trip board (or vice versa) so that when the trip board strikes an obstruction and is biased with respect to the moldboard, the elastic torsion spring resiliently yields, and then causes the trip board to snap back to its original position with respect to the moldboard once the obstruction is removed.

14 Claims, 3 Drawing Sheets

PLOW TRIP BOARD BIASED BY ELASTIC TORSION JOINT

CROSS-REFERENCE TO RELATED APPLICATIONS

This application claims priority under 35 USC §119(e) to U.S. Provisional Patent Application 60/033,123 filed Dec. 10, 1996, the entirety of which is incorporated by reference herein.

FIELD OF THE INVENTION

This disclosure concerns an invention relating generally to plow blades, and more specifically to plow blade trip boards for snowplows.

BACKGROUND OF THE INVENTION

A trip board is a board pivotally attached beneath the lower edge of a plow moldboard, e.g., the moldboard of a snowplow. A biased torsion spring situated between the moldboard and the trip board maintains the trip board in a generally coplanar relationship (or other desired relationship) with the moldboard. When the trip board strikes an unyielding obstruction on the roadway (or other surface to be plowed) during plowing, the torsion spring surrenders to allow the trip board to pivot backwardly so that the obstruction may pass beneath the trip board. When the plow blade passes over the obstruction, the trip board then pivots back to its original position. The trip board thus eliminates stress and impact damage to a moldboard of a plow blade by giving way when an obstruction is encountered. An exemplary trip board of this type is illustrated in U.S. Pat. No. 5,437,113 to Jones. Other types of trip boards using helical springs and air springs are also known to the art, as illustrated in U.S. Pat. No. 4,635,387 to Haring and U.S. Pat. No. 3,279,104 to Wandscheer et al.

Some difficulties are encountered with the installation and use of the aforementioned trip boards, more specifically, with the installation and use of the springs used to actuate the trip boards. Initially, the springs contact only small areas on the trip board (at the areas on the trip board abutting the spring ends), and therefore greater pressure is exerted on the trip board at these areas than at other areas. This leads to greater stress at these portions of the trip board, and additionally leads to an uneven distribution of biasing force over the length of the trip board. Additionally, while spring-loaded trip boards prevent moldboards from being significantly damaged when obstructions are encountered, their performance is less than ideal because they tend to propel moldboards into the air by as much as a foot or more upon impacting an obstruction. This effect, which arises owing to the elasticity of the springs, can be jarring to both the plowing vehicle and its driver. Further, the springs used in the trip boards are relatively expensive; they generally have an estimated usable life of only 1–3 years; and they are dangerous to install and remove because they must generally be preloaded before installation.

SUMMARY OF THE INVENTION

The invention, which is defined by the claims set out at the end of this disclosure, is directed to an improved plow trip board which diminishes or eliminates the aforementioned disadvantages. The improvement is accomplished by utilizing an elastic torsion joint to bias the trip board with respect to the plow moldboard. Elastic torsion joints are known components exemplified by U.S. Pat. No. 3,436,069 to Henschen and U.S. Pat. No. 5,591,083 to Kirschey which have previously generally been used as non-rigid couplings between shafts in vehicle powertrains and the like. Such elastic torsion joints include an elongated outer sleeve having an inner sleeve surface, an elongated inner member pivotally borne within the outer sleeve and having an outer member surface at least partially surrounded by the inner sleeve surface, and at least one elongated resilient elastic cushioning wedge situated between the inner sleeve surface and the outer member surface. The inner member and outer sleeve of the elastic torsion joint may be shaped to define a series of distinct cavities between the outer member surface and the inner sleeve surface, and the elastic cushioning wedges may be situated within these cavities. Planar sections on the outer surface of the inner member and/or on the inner surface of the outer sleeve may be provided whereupon the cushioning wedges are situated. In any case, rotation of the inner member with respect to the outer sleeve causes the outer surface of the inner member to bear down on the cushioning wedges and force them against the inner surface of the outer sleeve. The cushioning wedges, being made of a resiliently compressible material such as elastomeric rubber, resist such rotation with the magnitude of resistance increasing with the amount of rotation.

The lengths of the outer sleeve and inner member are respectively attached along the lengths of the trip board and the moldboard (or vice versa). Thus, when the trip board encounters a roadway obstruction and is biased with respect to the moldboard, the inner member of the torsion joint is biased with respect to the outer sleeve, and compression of the cushioning wedge(s) occurs. The resilient elasticity of the cushioning wedge(s) will cause the trip board to rotate back into its original position after the biasing force of the obstruction is removed.

The advantages of using elastic torsion joints in place of conventional springs to bias trip boards with respect to their associated moldboards are that (1) the elastic torsion joints do not need to be preloaded, or alternatively do not need to be preloaded to the same extent as a spring, to function in a trip board, and they are therefore safer to install and work with; (2) trip boards utilizing elastic torsion joints do not react as violently as trip boards utilizing springs when obstructions are encountered, since elastic torsion joints exhibit a damping response as well as elastic response; (3) where the cushioning members stretch along the lengths of the elastic torsion joints, they apply very even torque pressures along the lengths of the trip board and moldboard; (4) the elastic torsion joints have lifespans which are approximately three times longer than those of springs suitable for use in trip boards; and (5) the elastic torsion joints cost approximately half as much as springs having similar torque characteristics and structures suitable for use in trip boards.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
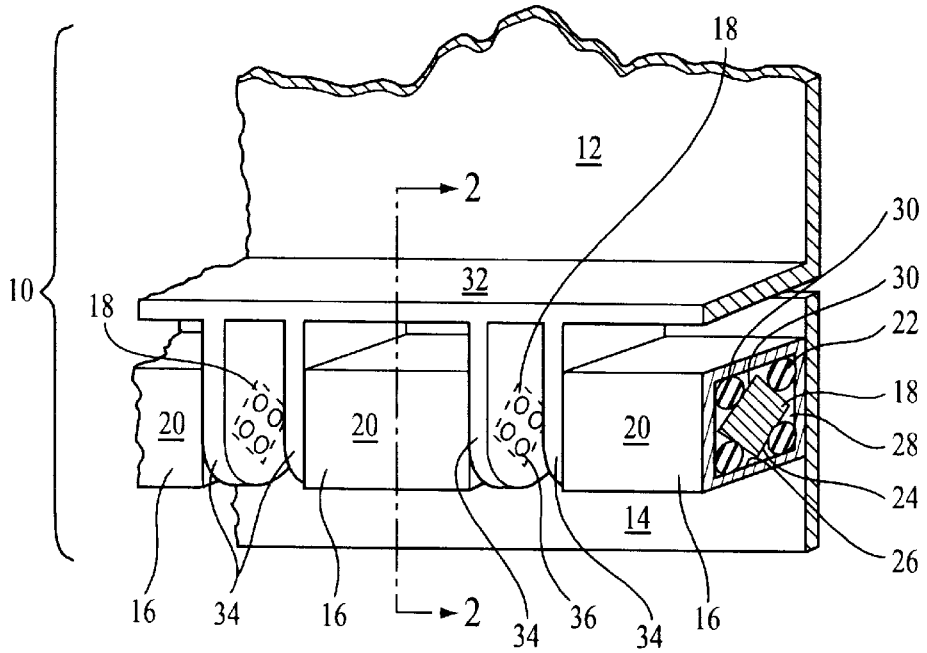
FIG. 1 is a partial sectional view of the rear of a plow blade 10, with the plow blade 10 being cut away along a plane situated at the right-hand side of FIG. 1.

In the drawings, wherein the same or similar features of the invention are designated in all Figures with the same reference numerals, FIG. 1 illustrates a partial sectional view of a plow blade 10 cut away along a plane situated at the right-hand side of the Figure. The plow blade 10 includes a first section 12 and a second section 14 extending adjacently along the first section 10. In general, the second section 14 will be a trip board for traveling immediately above the roadway (or other surface to be plowed) during plowing, and the first section 12 will be a moldboard situated above the trip board for receiving plowed matter; thus, the first and second sections 12 and 14 will henceforth be referred to as the moldboard 12 and the trip board 14. However, it should be understood that in other plowing applications where segmented plow blades 10 may be valuable, the first and second sections 12 and 14 might define other portions of the plow blade 10.

Figure 2:
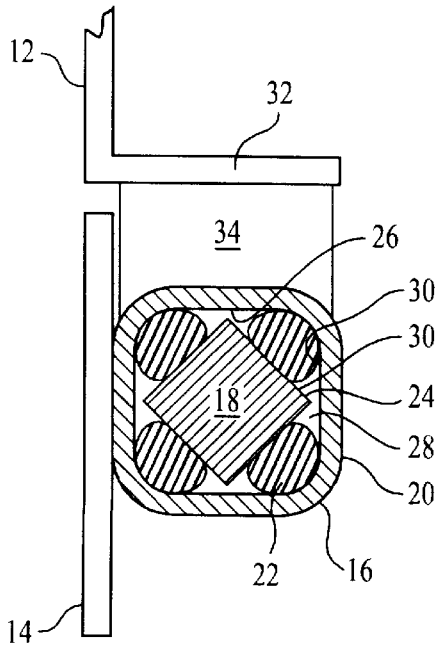
FIG. 2 is a sectional side view of the plow blade 10 of FIG. 1 shown along the plane 2—2 of FIG. 1.
Figure 3:
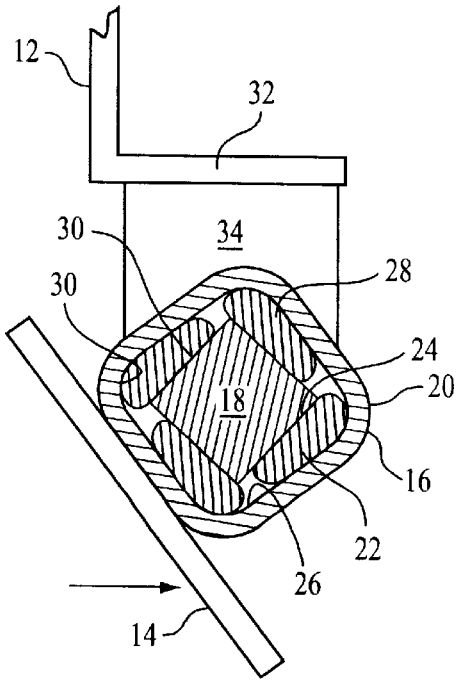
FIG. 3 is a sectional side view of the plow blade 10 of FIG. 2 shown with the trip board 14 biased with respect to the moldboard 12.

Elastic torsion joints 16 bias the trip board 14 with respect to the moldboard 12 to maintain the trip board 14 in a desired plane with respect to the moldboard 12, generally in a substantially coincident plane. As best illustrated in FIGS. 2–3, the elastic torsion joint 16 includes an inner member 18, an outer sleeve 20, and elastic cushioning wedges 22 situated between the outer member surface 24 of the inner member 18 and the inner sleeve surface 26 of the outer sleeve 20. The inner member 18 is appropriately sized and shaped so that it can pivot within the outer sleeve 20, or rotate within the outer sleeve 20 with a small amount of clearance. Additionally, the inner member 18 and outer sleeve 20 are shaped to define a series of distinct cavities 28 between the outer member surface 24 and inner sleeve surface 26, with a cushioning wedge 22 situated within each of the cavities 28. The cavities 28 are preferably defined by forming at least one substantially planar section 30 on the outer member surface 24 and inner sleeve surface 26 against which the cushioning wedges 22 may bear, and as FIGS. 1–3 illustrate, the inner member 18 and the outer sleeve 20 may each have a polygonal cross-section so that they both have a number of such planar sections 30. The cushioning wedges 22 are preferably made of a substantially elastic solid or semisolid, e.g., solid or cellular (e.g., foamed) elastomerics such as rubber.

As shown in FIGS. 1–3, the moldboard 12 has a rearwardly-extending flange 32 with downwardly-descending tongues 34 to which the inner member 18 is affixed by fasteners 36, or alternatively welding or other means of fixture. Each outer sleeve 20 is interposed between two such tongues 34. The outer sleeve 20 is then connected to the trip board 14 by means of fasteners (not shown), or alternatively welding or other means of fixture.

As best shown by FIGS. 2–3, when the plow blade 10 is pushed forwardly against matter and the front of the trip board 14 encounters an obstacle, the trip board 14 will be pushed rearwardly. The force is transmitted from the outer sleeve 20 to the cushioning wedges 22 situated between the outer member surface 24 of the inner member 18 and the inner sleeve surface 26 of the outer sleeve 20, causing the cushioning wedges 22 to deform from the state illustrated in FIG. 2 to the state illustrated in FIG. 3. With reference to FIG. 1, since the corners of the tongues 34 are rounded, the tongues 34 do not interfere with the rotation of the trip board 14 with respect to the moldboard 12. As particularly illustrated by FIG. 1, it is preferable that the interiors of all elastic torsion joints 16 (i.e., the interiors of the outer sleeves 20) be fully enclosed so that grit and detritus from the roadway (or other surface to be plowed) does not enter the interior of the elastic torsion joint 16 during plowing, thereby causing premature wear of the cushioning wedges 22. In the case that one or more elastic torsion joints 16 need to be replaced, the fasteners 36 affixing the tongues 34 to the inner member 18 are removed (or a means of fixture other than fasteners 36 are used, the moldboard 12 is detached from the inner member 18 in accordance with the structure and function of these fixture means). If the moldboard 12 is disconnected from all inner members 18 of all elastic torsion joints 16, the trip board 14 may then detached from the moldboard 12. The outer sleeve(s) 20 of the elastic torsion joint(s) 16 can then be detached from the trip board 14 in accordance with the structure and function of the means of fixture used to affix the outer sleeve 20 to the trip board 14. Each elastic torsion joint 16 may then be replaced with a new elastic torsion joint 16, and the trip board 14 may be reaffixed to the moldboard 12 by reversing the steps just described.

Figure 4:
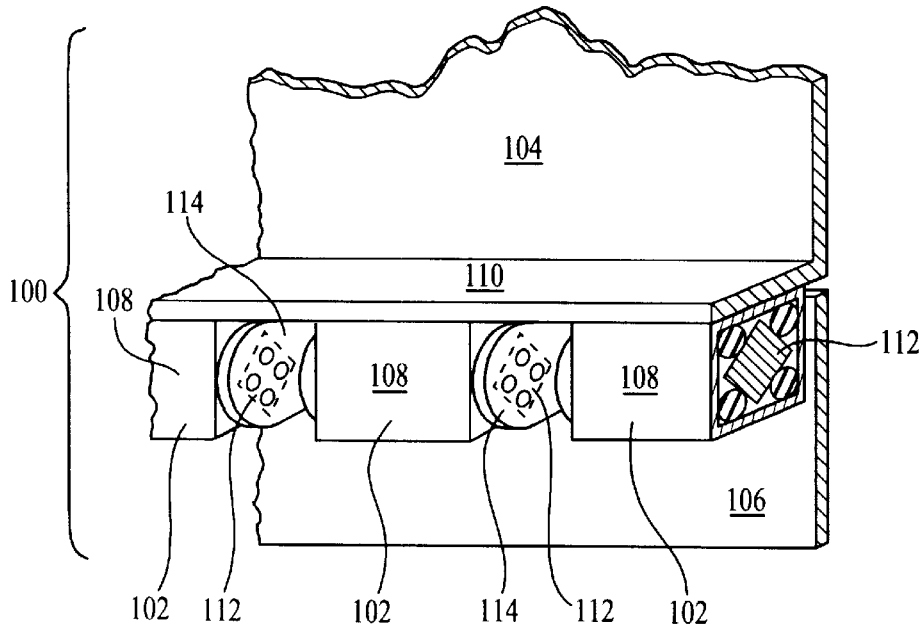
FIG. 4 illustrates an alternate embodiment of the plow blade 10 of FIG. 1, and shows a partial sectional view of the rear of a plow blade 100, with the plow blade 10 being cut away along a plane situated at the right-hand side of FIG. 4.

FIG. 4 then illustrates an alternate embodiment of the plow blade 10 at the reference numeral 100. In the plow blade 100, elastic torsion joints 102 bias a moldboard 104 with respect to a trip board 106 as in the plow blade 10 illustrated in FIGS. 1–3, but each elastic torsion joint 102 has an outer sleeve 108 affixed to the moldboard 104 at a flange 110, and an inner member 112 affixed to the trip board 106 at tongues 114 extending from the trip board 106, in reverse of the arrangement illustrated in the plow blade 10.

Figure 5:
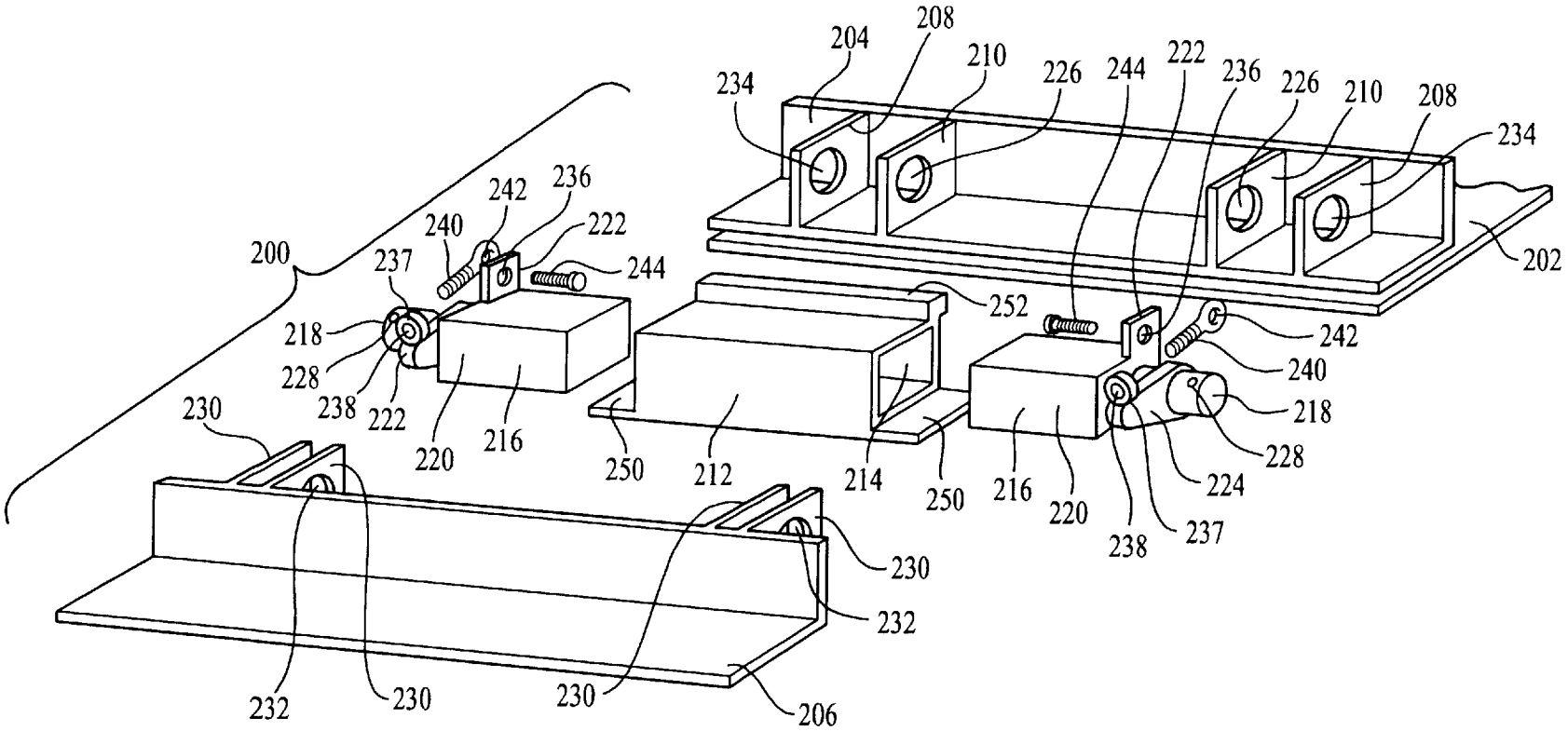
FIG. 5 provides an exploded perspective view of an alternate attachment arrangement suitable for use in affixing a trip board to a plow blade.

FIG. 5 then illustrates an alternate and particularly preferred embodiment of the aforementioned plow blades at the reference numeral 200. In the plow blade 200, a section of a moldboard 202 is shown in association with a moldboard attachment angle 204, which is used to connect the moldboard 202 with a trip board 206. The moldboard attachment angle 204 includes opposing tripboard attachment flanges 208, and opposing torsion joint mounting flanges 210 situated between the tripboard attachment flanges 208. A torsion joint housing 212 having a torsion joint receiving cavity 214 is then provided for receiving two torsion joints 216, each torsion joint 216 complementarily fitting within the torsion joint receiving cavity 214 at one of the opposing ends of the torsion joint housing 212. It is noted that the torsion joints 216 are different from those described above insofar as their inner members (not shown) are connected along their axes to rodlike shafts 218, and they include outer sleeves 220 which essentially define canisters enclosing the inner members so that the shafts 218 protrude from one end of the sleeves 220. This arrangement prevents road grit or other foreign matter from entering the torsion joints 216 to cause premature wear. The torsion joints 216 also differ from those described above in that they include sleeve anchor flanges 222 affixed to the outer sleeves 220 and torsion wings 224 affixed to the shafts 218, as will be discussed at greater length below.

The torsion joints 216 are sized so that they can both be inserted into the torsion joint receiving cavity 214 of the torsion joint housing 212 to such an extent that the torsion joint housing 212 can be closely fit onto the moldboard attachment angle 204 between the torsion joint mounting flanges 210. The torsion joints 216 are then pulled from the torsion joint housing 212 to such an extent that their shafts 218 may be inserted within shaft apertures 226 in the torsion joint mounting flanges 210. The shafts 218 are then pinned at pin apertures 228 or otherwise axially locked in place so that the torsion joints 216 cannot slide within the torsion joint housing 212. This affixment of the shafts 218 with respect to the torsion joint mounting flanges 210 has the effect of maintaining the torsion joint housing 212 on the moldboard attachment angle 204 in such a manner that it (as well as the outer sleeves 220 of the torsion joints 216) cannot slide, rotate, or otherwise move with respect to the moldboard attachment angle 204. However, the shafts 218 of the torsion joints 216 may be rotated with respect to the moldboard attachment angle 204 when sufficient torque is applied.

The trip board 206, which includes moldboard attachment flanges 230, is then affixed to the moldboard attachment angle 204 by situating moldboard attachment flanges 230 adjacent the trip board attachment flanges 208, and by situating the torsion wings 224 of the torsion joints 216 so that they bear against the trip board 206. The moldboard attachment flanges 230 and trip board attachment flanges 208 respectively include apertures 232 and 234 for receiving axles (not shown). These axles are pinned or otherwise affixed within the apertures 232 and 234, thereby pivotally affixing the moldboard attachment flanges 230 and trip board attachment flanges 208 (and thus pivotally affixing the trip board 206 to the moldboard attachment angle 204 and moldboard 202). The torsion wings 224 press against the trip board 206 to bias it into the desired relationship with respect to the moldboard 202.

Figure 6:
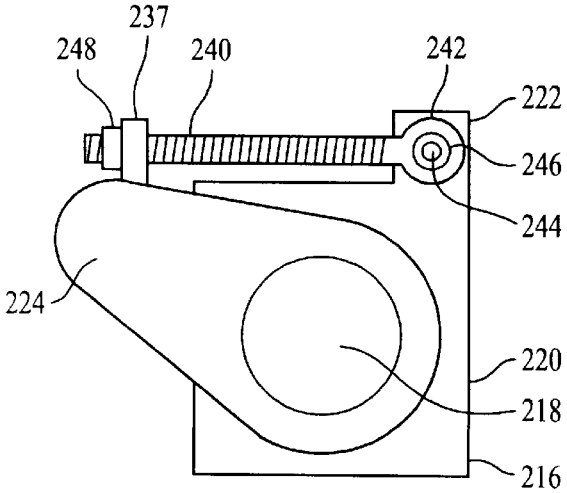
FIGS. 6 and 7 are partial side views of the arrangement of FIG. 5 illustrating the torsion joint 216.
Figure 7:
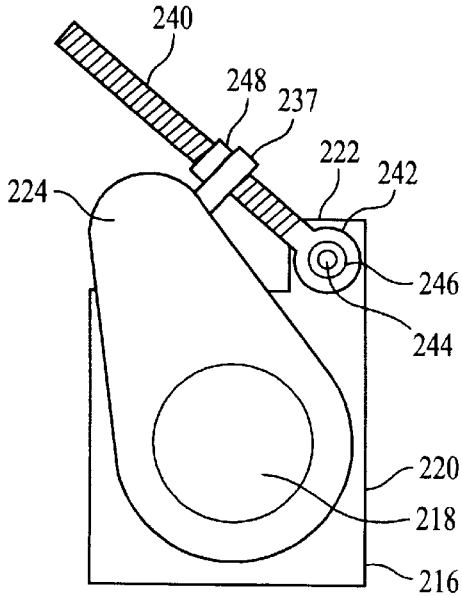

In some cases, it may be desirable to preload the torsion joints 216 prior to installation so that the trip board 206 is biased to some desired angle and/or has the desired degree of resistance to rotation. Preloading can be performed by use of the sleeve anchor flanges 222, which include sleeve anchor apertures 236, in conjunction with torsion wing anchors 237 attached to the torsion wings 224. Similarly to the sleeve anchor flanges 222, the torsion wing anchors 237 include wing anchor apertures 238. As best illustrated by FIG. 6, wing anchor pins 240, which terminate in eyes 242, are inserted within the wing anchor apertures 238 so that the eyes 242 are situated generally adjacent the sleeve anchor flanges 222. Sleeve anchor pins 244 are then inserted within the sleeve anchor apertures 236 so that they each extend into the eyes 242 of the wing anchor pins 240. Nuts 246 (only illustrated in FIGS. 6–7) may then be applied to the ends of sleeve anchor pins 244 to prevent the sleeve anchor pins 244 from disengaging from the wing anchor pins 240. Nuts 248 can then be applied to the wing anchor pins 240 so that when the nuts 248 are tightened, the torsion wings 224 are rotated from the exemplary position illustrated in FIG. 6 to that shown in FIG. 7. With the torsion wings 224 resting in the position shown in FIG. 7, the torsion joint housing 212 and torsion joints 216 may be installed in the moldboard attachment angle 204 even if the moldboard backer angle 204 and trip board 206 are already attached, and the wing anchor pins 240, sleeve anchor pins 244, and nuts 246 and 248 may be removed so that the torsion wings 224 may bear on the trip board 206 without restraint.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, FIGS. 1 and 4 illustrate the use of several elastic torsion joints between the moldboard and the trip board, thereby ensuring that stresses are relatively evenly distributed across both the moldboard and the trip board owing to their multiple attachments to the elastic torsion joints. However, if desired, only a single elastic torsion joint can be used to attach the moldboard to the trip board, with this elastic torsion joint extending over a larger portion of the moldboard and trip board.

Second, the elastic torsion joints of the embodiments of FIGS. 1–4 are illustrated as being attached to their moldboards and trip boards by direct attachment or via tongues. It should be appreciated that depending on the size and shape of the moldboard and trip board in question, the size and shape of the elastic torsion joints, the desired location of the pivot axis of the elastic torsion joint, and similar factors, the location of the elastic torsion joint, moldboard, and trip board may vary with respect to each other, and the means of fixture may vary. For example, the pivot axis of the elastic torsion joint may be distanced from either of the moldboard and trip board by use of spacing plates or washers, or by attaching the elastic torsion joints to the moldboard and/or trip board via collars or flanges that perform a spacing function.

Third, the outer sleeves and inner members of the elastic torsion joints can have a variety of cross-sectional areas and cross-sectional shapes, and the cushioning wedges may also vary in cross-sectional area and shape. Exemplary arrangements are shown in U.S. Pat. No. 3,436,069 to Henschen. If desired, multiple cushioning wedges may be situated within each cavity between the outer sleeve and inner member, e.g., smaller cushioning wedges may be placed on opposite sides of the cushioning wedges illustrated in the Figures. Different elastic torsion joint configurations, perhaps having different elastic resistances, may be used in the same plow blade.

Fourth, with reference to FIG. 5, it is noted that torsion joint housing 212 includes bottom spacer plates 250 and an upper clip flange 252 for preventing lateral slippage and axial pivoting of the torsion joint housing 212 within the moldboard attachment angle 204. The bottom spacer plates 250 and upper clip flange 252, while nonessential, have been found to lead to beneficial results in the insertable torsion joint plow blade shown in FIGS. 5–7 in that they prevent the minor amount of pivoting and/or slippage of the torsion joint housing 212 that might otherwise be present. While the torsion joint housing 212 is shown as an integral component in FIG. 5, it may be formed of metal tubing having bottom spacer plates 250 and an upper clip flange 252 welded thereon, or alternatively may be formed of a single appropriately-configured metal plate which is bent to form a torsion joint housing 212 having the same general structure and function as that shown in FIG. 5. One skilled in the art will readily realize that other construction schemes may be used as well, e.g., a combination of the aforementioned schemes. One skilled in the art will also realize that torsion joint housings having other configurations apart from the one shown are readily conceivable, the most important aspect of the torsion joint housing being its function of removably receiving torsion joints for easy replacement, and which is itself removably received on the plow blade or trip board. These functions lead to significant savings in the time, ease, safety, and cost of trip board installation and upkeep.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, any means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A plow blade including a moldboard, a trip board, and an elastic torsion joint biasing the trip board with respect to the moldboard, wherein the elastic torsion joint includes:

a. an inner member having an outer member surface, b. an outer sleeve wherein the inner member is pivotally suspended, the outer sleeve having an inner sleeve surface at least partially surrounding the outer member surface, and c. a least one resilient elastic cushioning wedge situated between the inner sleeve surface and the outer member surface, wherein the outer sleeve and the inner member are each affixed to a respective one of the moldboard and the trip board, and wherein pivoting the inner member with respect to the outer sleeve causes the outer member surface of the inner member to compress the cushioning wedge against the inner sleeve surface of the outer sleeve.

2. The plow blade of claim 1 wherein the inner member and the outer sleeve are shaped to define a series of distinct cavities therebetween, and wherein at least one of the at least one resilient elastic cushioning wedges is situated within at least one of the cavities.

3. The plow blade of claim 1 wherein the outer member surface bears at least one substantially planar segment thereon.

4. The plow blade of claim 1 wherein the outer member surface is substantially polygonal.

5. The plow blade of claim 1 wherein the inner sleeve surface bears at least one substantially planar section thereon.

6. The plow blade of claim 1 wherein the inner sleeve surface is at least partially defined by a plurality of discrete surfaces.

7. The plow blade of claim 1 wherein the inner member is affixed to the moldboard.

8. The plow blade of claim 1 wherein the inner member is affixed to the trip board.

9. The plow blade of claim 1 wherein the sleeve is affixed to the moldboard.

10. The plow blade of claim 1 wherein the sleeve is affixed to the trip board.

11. A plow blade including a moldboard, a trip board, and at least one resilient elastic cushioning wedge pivotally and elastically biasing the trip board with respect to the moldboard, wherein the resilient elastic cushioning wedge is situated between an outer sleeve and an inner member pivotally situated within the outer sleeve, the cushioning wedge thereby resiliently biasing the inner member with respect to the outer sleeve when the inner member is pivoted with respect to the outer sleeve, and wherein the moldboard and the trip edge are each attached to a respective one of the inner member and the outer sleeve.

12. The plow blade of claim 11 wherein pivoting the inner member with respect to the outer sleeve compresses the cushioning wedge.

13. The plow blade of claim 11 wherein the inner member and the outer sleeve are each shaped to define a series of distinct cavities therebetween, and wherein a resilient elastic cushioning wedge is situated within at least one of the cavities.

14. A plow blade including a moldboard, a trip board, and an elastic torsion joint biasing the trip board with respect to the moldboard, the elastic torsion joint including resilient elastic cushioning wedges interposed between an outer sleeve and an inner member, the inner member being pivotally supported within the outer sleeve by the cushioning wedges, with the outer sleeve and the inner member affixed to a respective one of the moldboard and the trip board.

* * * * *